US005109828A

United States Patent [19]

Tagami et al.

[11] Patent Number: 5,109,828

[45] Date of Patent: May 5, 1992

[54] APPARATUS FOR SUPPLYING HIGH VOLTAGE TO SPARK PLUG OF INTERNAL COMBUSTION ENGINE

[75] Inventors: Hitoshi Tagami, Kariya; Masayasu Ushida, Chiryu; Taro Tabata, Anjo, all of Japan

[73] Assignee: Nippondenso Co., Ltd., Kariya, Japan

[21] Appl. No.: 674,854

[22] Filed: Mar. 26, 1991

[30] Foreign Application Priority Data

Mar. 27, 1990 [JP] Japan ..... 2-079118
Jan. 17, 1991 [JP] Japan ..... 3-003812

[51] Int. Cl.[5] ..... F02P 3/02

[52] U.S. Cl. ..... 123/635; 123/647

[58] Field of Search ..... 123/143 C, 169 CA, 169 PA, 123/634, 635, 647, 643; 336/96, 105, 107

[56] References Cited

U.S. PATENT DOCUMENTS

| | | | |
|---|---|---|---|
| 4,515,141 | 5/1985 | Saeä et al. | 123/647 |
| 4,617,907 | 10/1986 | Johansson et al. | 123/647 |
| 4,637,368 | 1/1987 | Gillbrand et al. | 123/647 |
| 4,665,922 | 5/1987 | Gillbrand et al. | 123/647 |
| 4,671,248 | 6/1987 | Gillbrand et al. | 123/647 |
| 4,706,638 | 11/1987 | Johansson et al. | 123/647 |
| 4,706,639 | 11/1987 | Boyer et al. | 123/647 |
| 4,831,995 | 5/1989 | Biton | 123/635 |
| 4,893,105 | 1/1990 | Maeda et al. | 123/634 X |
| 4,903,674 | 2/1990 | Bassett et al. | 123/634 |
| 4,903,675 | 2/1990 | Huntzinger et al. | 123/635 |

FOREIGN PATENT DOCUMENTS

| | | | |
|---|---|---|---|
| 2624559 | 6/1989 | France | 123/647 |
| 0190673 | 9/1985 | Japan | 123/647 |
| 0092576 | 4/1989 | Japan | 123/635 |
| 1498942 | 1/1978 | United Kingdom | 123/635 |

*Primary Examiner*—Willis R. Wolfe
*Attorney, Agent, or Firm*—Cushman, Darby & Cushman

[57] ABSTRACT

Apparatus for supplying high voltage to each spark plug of a multi-cylinder internal combustion engine via a spark coil includes a distributor plate of a unitary construction made of an electrically-insulative resin and having an integral base portion and an integral connector. A plurality of connecting lines are embedded in the base portion. One ends of the connecting lines are electrically connected respectively to spark coils whereas the other ends thereof extend to the connector. The distributor plate and the spark coils can be fixed, as a unit, to the internal combustion engine by a bracket of metal.

18 Claims, 9 Drawing Sheets

APPARATUS FOR SUPPLYING HIGH VOLTAGE TO SPARK PLUG OF INTERNAL COMBUSTION ENGINE

FIELD OF THE INVENTION AND RELATED ART STATEMENT

This invention relates to apparatus for supplying a high voltage to spark plugs of an internal combustion engine.

In a conventional apparatus of this type, as in Japanese Early-Published Patent Application No. 501961/85 of PCT application, a tubular protective sleeve is provided for each of the plug holes formed in a cylinder head, and an outer casing is formed integrally therewith. A spark coil received in a coil case is inserted into the protective sleeves, respectively, and the spark coils are connected to a connector via a printed circuit board or lead wires.

In the above conventional apparatus since the spark coils need to be electrically connected to the connector via the printed circuit board or lead wires, the number of component parts is increased. This results in increased time and labor required for attaching the component parts.

OBJECT AND SUMMARY OF THE INVENTION

It is therefore an object of the present invention to provide an apparatus for supplying a high voltage to a spark plugs of an internal combustion engine, in which a relatively small number of component parts are used; thus reducing the time and labor required for attaching the component parts.

According to the present invention, a distributor plate and coil towers, as an integral unit, are fixed to an internal combustion engine by a metal bracket.

The function and the features of the present invention will become manifest from the following detailed description of the preferred embodiments and the accompanying drawings.

DETAILED DESCRIPTION OF PREFERRED EMBODIMENTS

Figure 1:
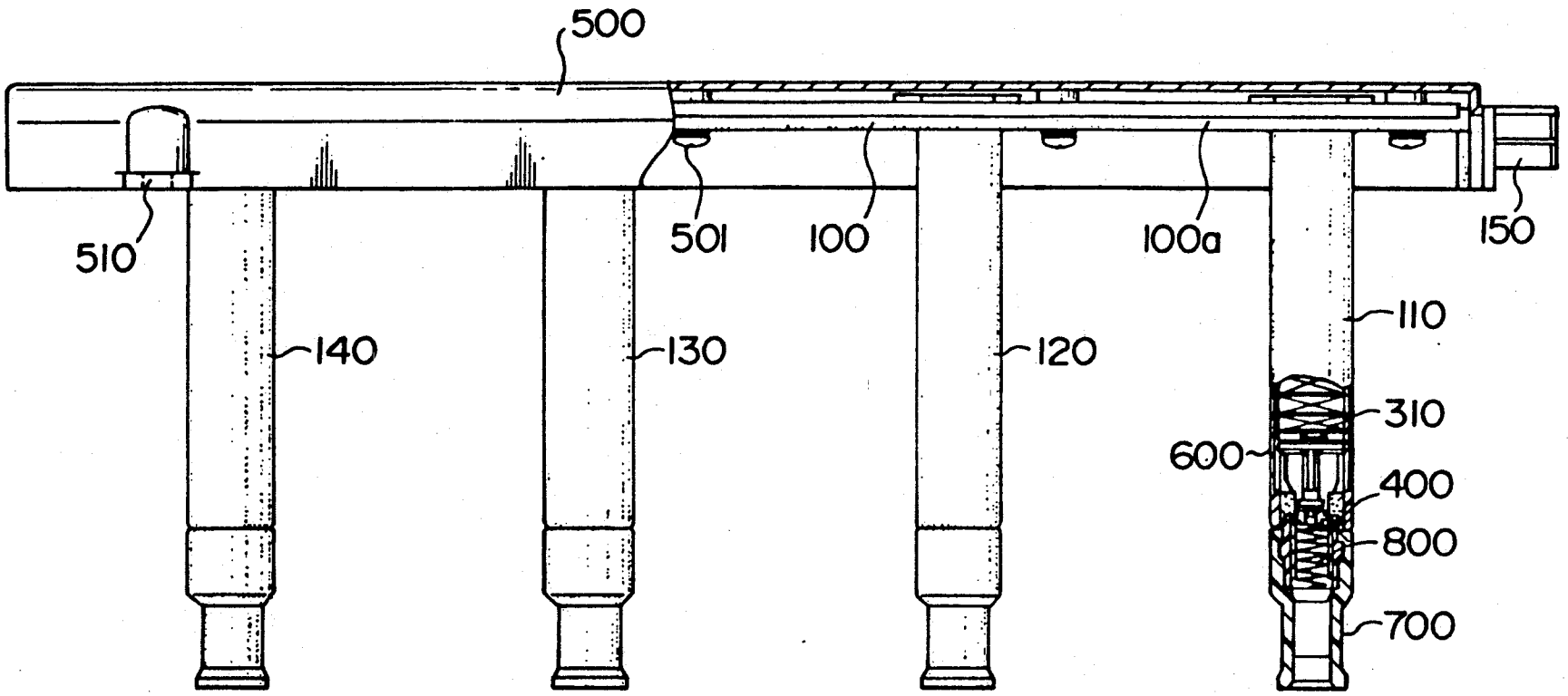
FIG. 1 is a partly cross-sectional front view of a first embodiment of an apparatus of the present invention.
Figure 2:
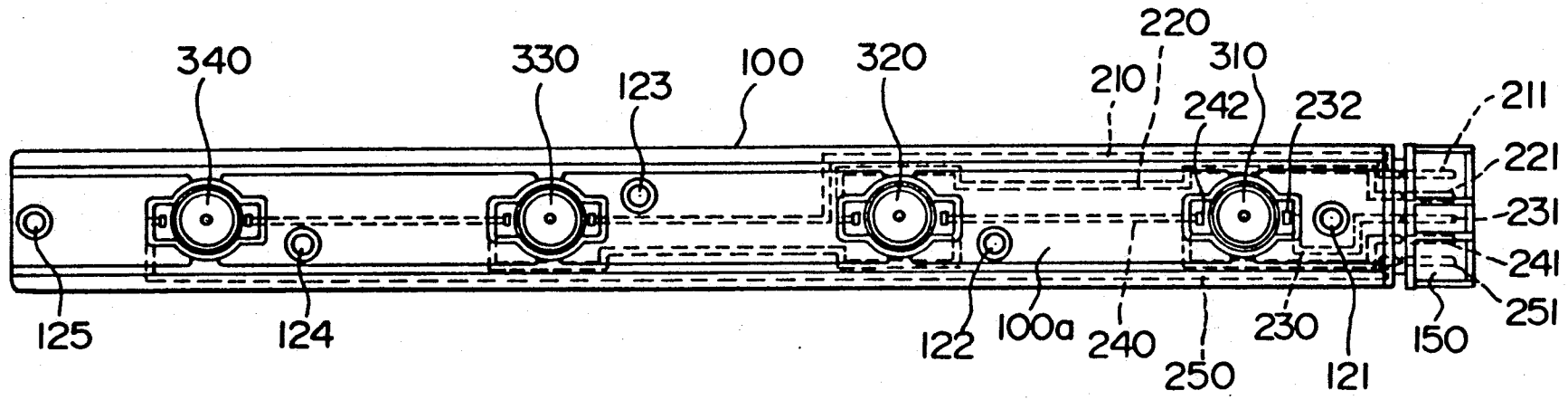
FIG. 2 is a plan view of the first embodiment with a bracket removed.

Referring to FIGS. 1 and 2, a first embodiment of the high voltage-supplying apparatus of the present invention includes a coil case 100 molded of an electrically-insulative synthetic resin such as polybutyleneterephthalate (PBT). The coil case 100 comprises a distributor plate including a flat base portion 100*a*, connector 150, and four cylindrical coil towers 110, 120, 130 and 140 extending vertically from the base portion 100*a* and spaced from one another at substantially equal intervals. The positions of the four coil towers 110, 120, 130 and 140 correspond respectively to the positions of four spark plugs (not shown) mounted respectively on cylinders of an engine.

Coil windings 310, 320, 330 and 340 are received within the coil towers 110, 120, 130 and 140, respectively.

A plurality of connecting lines 210, 220, 230, 240 and 250, each made of a metallic plate (e.g. copper alloy) having an excellent electrical conductivity, are embedded in the base portion 100*a* of the coil case 100. The connecting line 240 feeds electric power from a power source, and the other connecting lines 210, 220, 230 and 250 feed ignition signals. In this embodiment, electric power is supplied to the four coil windings 310, 320, 330 and 340 via the common power-supplying connecting line 240.

Referring particularly to the coil winding 310, one end of the primary and secondary coils of the coil winding 310 are connected to one end 242 of the connection line 240 projected upwardly from the base portion 100*a* of the coil case 100. The other end of the primary coil is connected to one end 232 of the ignition signal line 230 projected upwardly from the coil case base portion 100*a*. The other ends 241 and 231 of these lines 240 and 230 are projected into the connector 150 which is provided at one end of the coil case base portion 100*a* and is molded integrally with this base portion 100*a*. The other end of the secondary coil is connected to a cap-shaped metal high voltage terminal 400 provided at the lower end portion of the coil tower 110 so as to feed a high voltage to the spark plug.

After the connection of the coil winding 310 to the terminals 232, 242 and 400 is made, the coil winding 310 is completely fixed to and retained within the coil tower 110 by a thermosetting resin 600 (e.g. epoxy resin) having excellent electrically-insulative properties.

The other coil windings 320, 330 and 340 are arranged in the same manner as described above for the coil winding 310.

The coil case base portion 100*a* has a plurality of mounting through holes 121 to 125. The base portion 100*a* is fixedly secured to a rigid bracket 500 of metal (e.g. aluminum) by screws 501 passing respectively through the mounting holes 121 to 125. Since the coil case base portion 100*a* is molded of a resin, the base portion 100*a* has a slight warpage due to the molding. However, upon fixing of the base portion 100*a* to the bracket 500, such warpage of the base portion 100*a* is eliminated, and its rigidity is enhanced.

A tubular, elastic bushing 700, which receives the spark plug when the spark coil is attached to the engine, is fitted in the lower end of each of the coil towers 110, 120, 130 and 140. A coil spring 800 of an electrically-conductive material is fixedly received within the high voltage terminal 400. The coil spring 800 ensures that the high voltage fed from the secondary coil to the high voltage terminal 400 is positively fed to the spark plug.

The high voltage supplying apparatus of the present invention is mounted between banks of on engine of the double overhead cam shaft-type. This apparatus is fixedly secured to a cylinder head (not shown) of the engine by bolts passing through mounting holes 510 formed in a plurality of tabs provided on the bracket 500. The coil towers 110, 120, 130 and 140 are positioned respectively in plug holes through which the spark plugs are mounted on the cylinder head.

The connector 150 of the coil case 100 is connected to a primary coil signal-generating circuit and a battery power source via an external connector (not shown). The ignition signal and a primary voltage are supplied to the primary coils of the coil windings 310 to 340 via the lines 210, 220, 230, 240 and 250 embedded in the base portion 100*a*. When the ignition signal is fed to the primary coil, high voltage is generated in the secondary coil, and the high voltage is supplied to the spark plug, via the high voltage terminal 400 and the coil spring 800.

Conventionally, when spark coils are to be attached to an engine, each of the spark coils is fixed to a respective one of cylinders by one or more bolts, and is connected to a power source and a primary coil signal-generating circuit via wires, a connector, and etc. Further, in many cases, for the purpose of improving the appearance, a decorative plate for covering the spark coils and the wiring elements is attached by screws or the like.

On the other hand, when the spark coils of this embodiment are to be attached to the engine, the coil towers 110, 120, 130 and 140 of the coil case 100 are inserted respectively into the plug holes so as to be opposed to the respective spark plugs, and the bracket 500 also serving as a decorative plate is fixedly secured by the bolts to the cylinder head of the engine, and thereafter the spark coils are electrically connected t the exterior through the sole connector 150. This is all that has to be done for attaching the spark coils to the engine.

Therefore, according to this embodiment, not only the time and labor required for attaching the spark coils but also the number of the component parts can be greatly reduced.

Figure 3A:
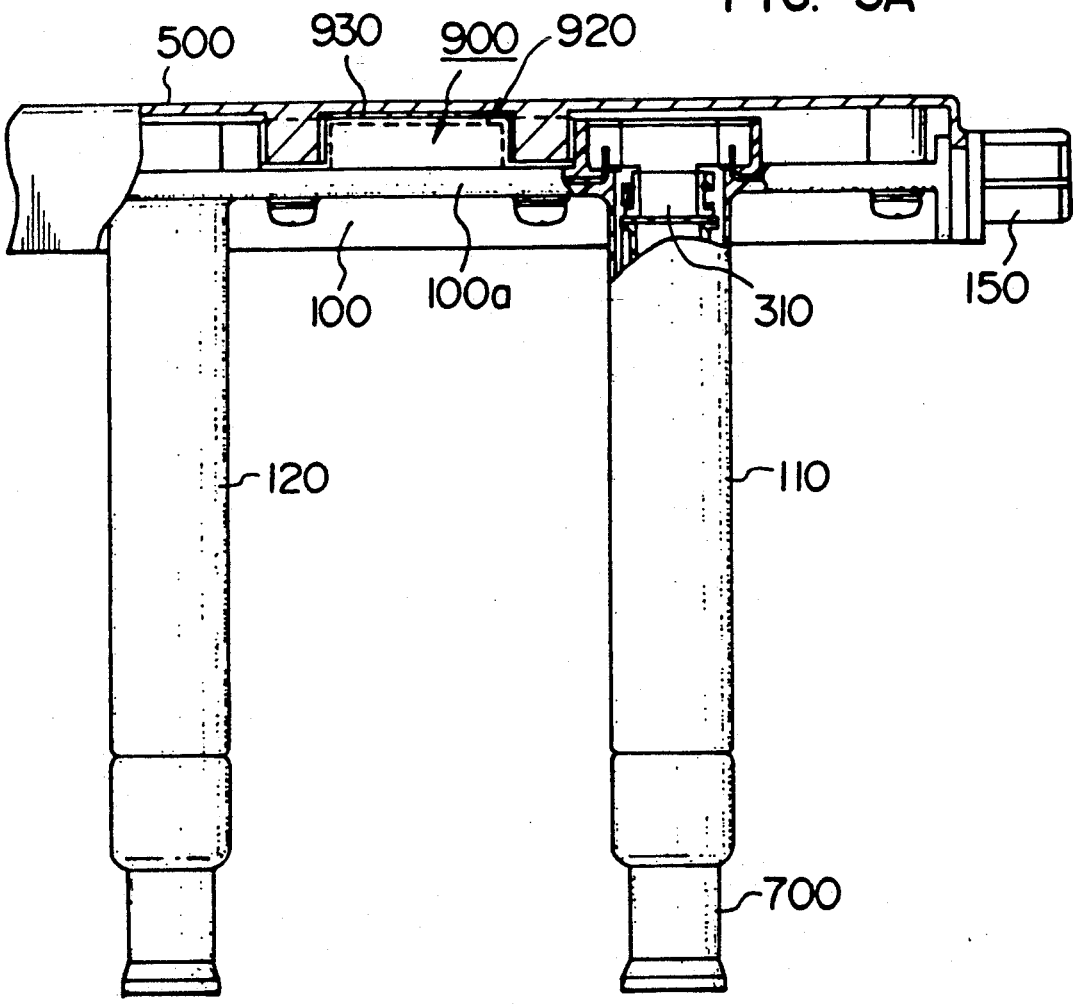
FIG. 3A is a fragmentary and partly cross-sectional front view of a second embodiment of an apparatus of the present invention.
Figure 3B:
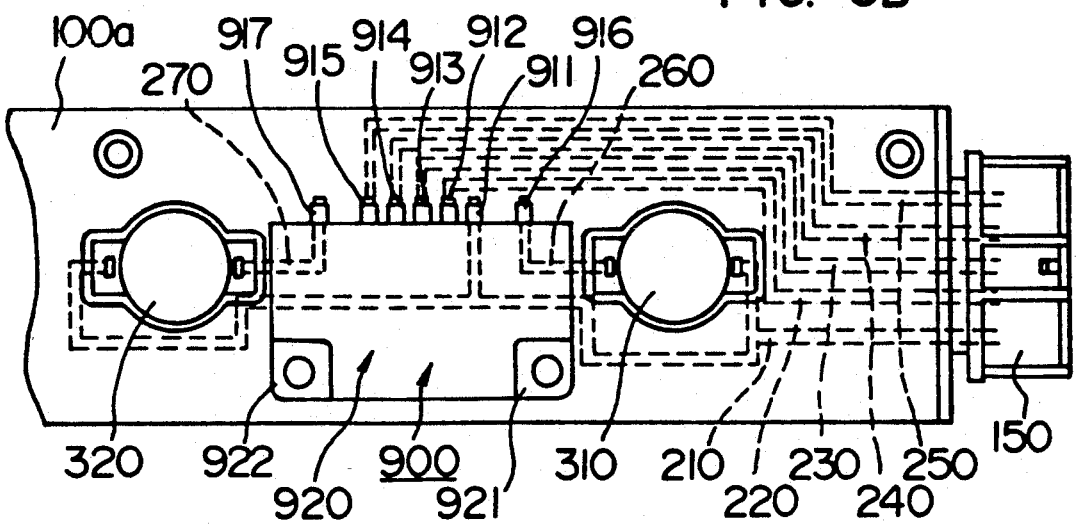
FIG. 3B is a plan view of the second embodiment with a bracket removed.

FIGS. 3A and 3B show a second embodiment of the invention which differs from the first embodiment in that there are provided igniters 900 having a primary coil signal-generating circuit for intermitting a primary coil current.

The number of the igniters 900 used here may be an or more. For example, one igniter 900 may be provided for each of coil windings 310, 320, 330 and 340, or one igniter 900 may be provided for the whole of the apparatus. In the second embodiment, an igniter 900 is associated with two of the coil windings.

Lines 220, 230, 240 and 250 embedded in a coil case base portion 100*a* electrically connect a coil case connector 150 to the igniter 900. A line 210 electrically connects the connector 150 to the coil windings 310 and 320. Lines 260 and 270 electrically connect the igniter 900 to the coil windings 310 and 320, respectively. The line 210 feeds electric power from a power source, and the line 220 is used for a monitor signal. The line 230 is used for the grounding, and the lines 240 and 250 are used for the input to the igniter. The line 260 and 270 are used for the output from the igniter 900.

Although the other lines not related to the coil windings 310 and 320 and the igniter 900 are omitted from the drawings, these lines are embedded in the coil case base portion 100*a* in a multi-layer manner.

The igniter 900 is mounted on the coil case base portion 100*a* in such a manner that terminals 911 to 917 of the igniter 900 are opposed respectively to one end of the lines 210 to 270 projected upwardly from the coil case base portion 100*a*. The connection of the lines 210 to 270 to the igniter 900 and the coil windings 310 and 320 are made by welding or soldering the mating terminals together.

The igniter 900 includes a radiator plate 920 of aluminum having flanges 921 and 922. The igniter 900 is positioned in place by fastening the flanges 921 and 922, together with the coil case base portion 100*a*, to a bracket 500 by screws. With this arrangement, the heat from the igniter 900 is transferred from the flanges 921 and 922 to the bracket 500, and then is radiated to the ambient atmosphere from the bracket 500.

If the heat transfer from the radiator plate 920 to the bracket 500 is inadequate, the heat radiating properties can be enhanced by filling a heat transfer material 930, such as grease, in a gap or space between the upper surface of the radiator plate 920 and the bracket 500. If it is desired to improve the radiation of the heat from the bracket 500 to the ambient atmosphere, this can be effectively done by providing radiating fins on the bracket 500.

Figure 4:
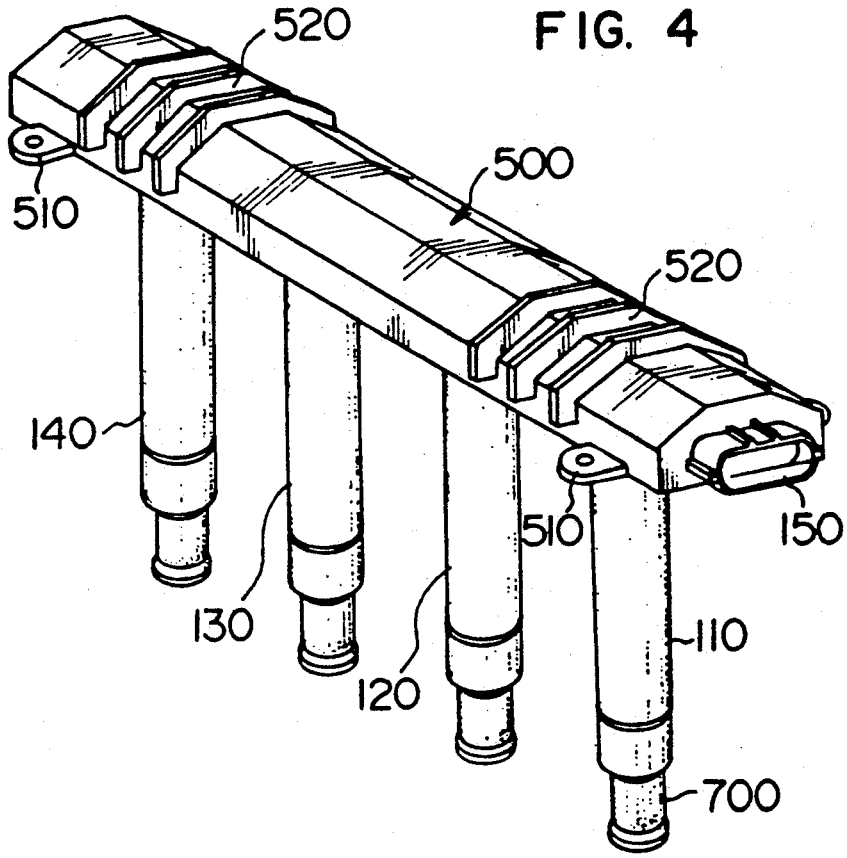
FIG. 4 is a perspective view of a third embodiment of an apparatus of the present invention.

FIG. 4 shows a third embodiment of a voltage supplying apparatus of the present invention utilizing a bracket 500 having radiating fins 520. When this apparatus is attached to the engine, bushings 700 are intimately fitted on the corresponding spark plugs respectively, and a considerably force is required for detaching the apparatus from the engine. Therefore, in the apparatus of this type, it is required to provide projections with which the operator's fingers or a tool can be engaged when detaching the apparatus from the engine.

Figure 5:
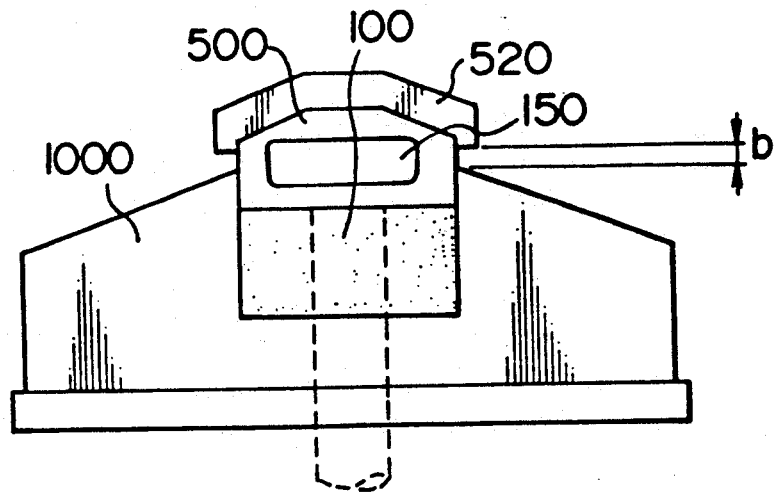
FIG. 5 is a side view of the third embodiment.

Accordingly, in this embodiment, as shown in FIG. 5, the fins 520 are so shaped as to provide a space b between the lower surface of the fins 520 and an engine head cover 1000 when the apparatus is attached to the engine suitable for detaching the apparatus. With this arrangement, by inserting the operator s finger or a tool such as a screw driver into the space b, the apparatus can be easily removed from the engine.

The constituent parts of the voltage supplying apparatus are protected by the bracket 500 from water. Additionally, it is necessary to protect the plug holes from water when the apparatus is attached to and detached from the engine.

Figure 6:
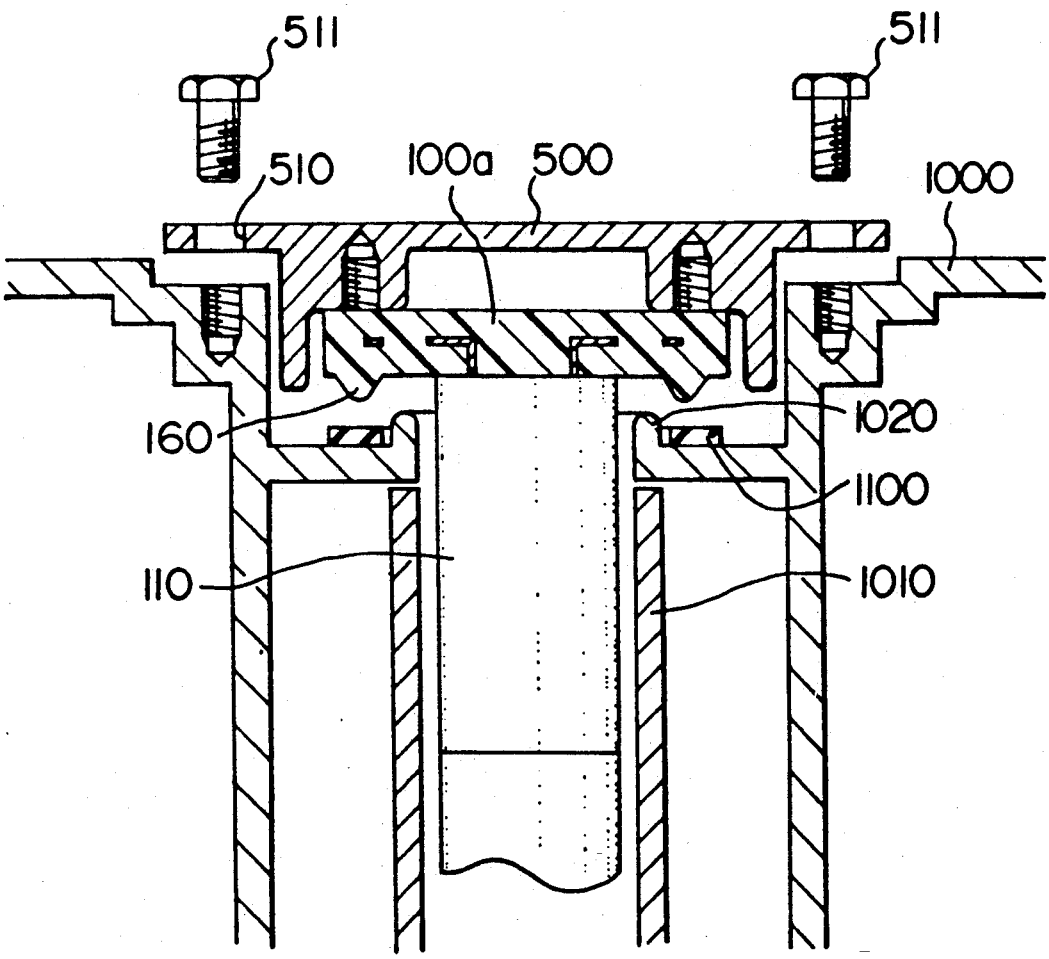
FIG. 6 is a fragmentary cross-sectional view showing an apparatus of the present invention attached to an engine.

To achieve this, as shown in FIG. 6, an annular projection 1020 is formed adjacent to the inlet of the plug hole 1010 so that water will hardly enter the plug hole 1010 when detaching the apparatus from the engine.

Further, an elastic seal member 1100 of a disk-shape or ring-shape is provided around the outer periphery of the annular projection 1020, and a part 160 of the coil case base portion 100*a* (or a part of the bracket 500) is pressed against the seal member 1100, thereby completing waterproofness. This pressing force is obtained when fastening the apparatus to the engine head cover 1000 by bolts or the like.

Figure 7:
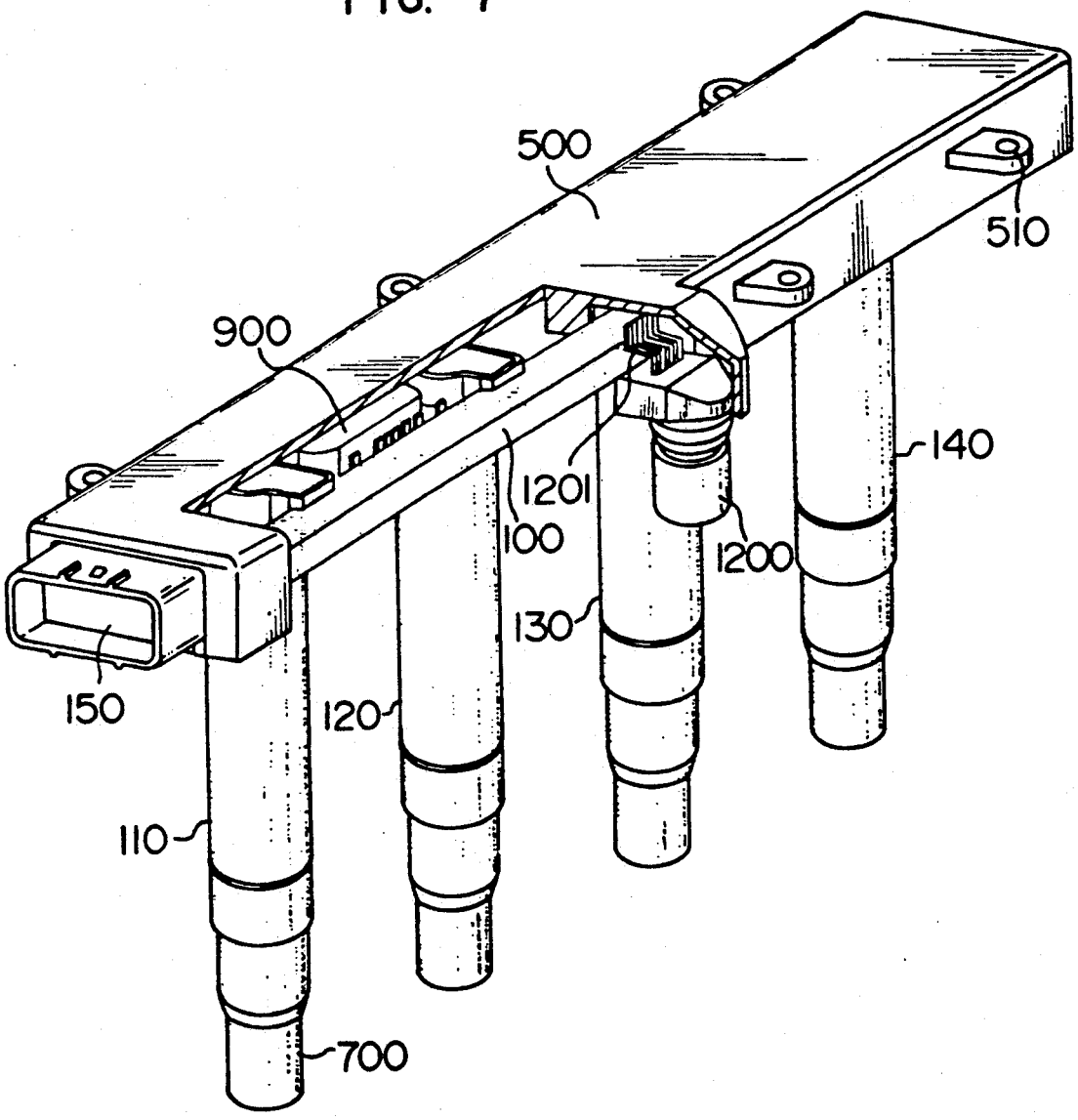
FIG. 7 is a partly-broken, perspective view of a fourth embodiment of an apparatus of the present invention.
Figure 8:
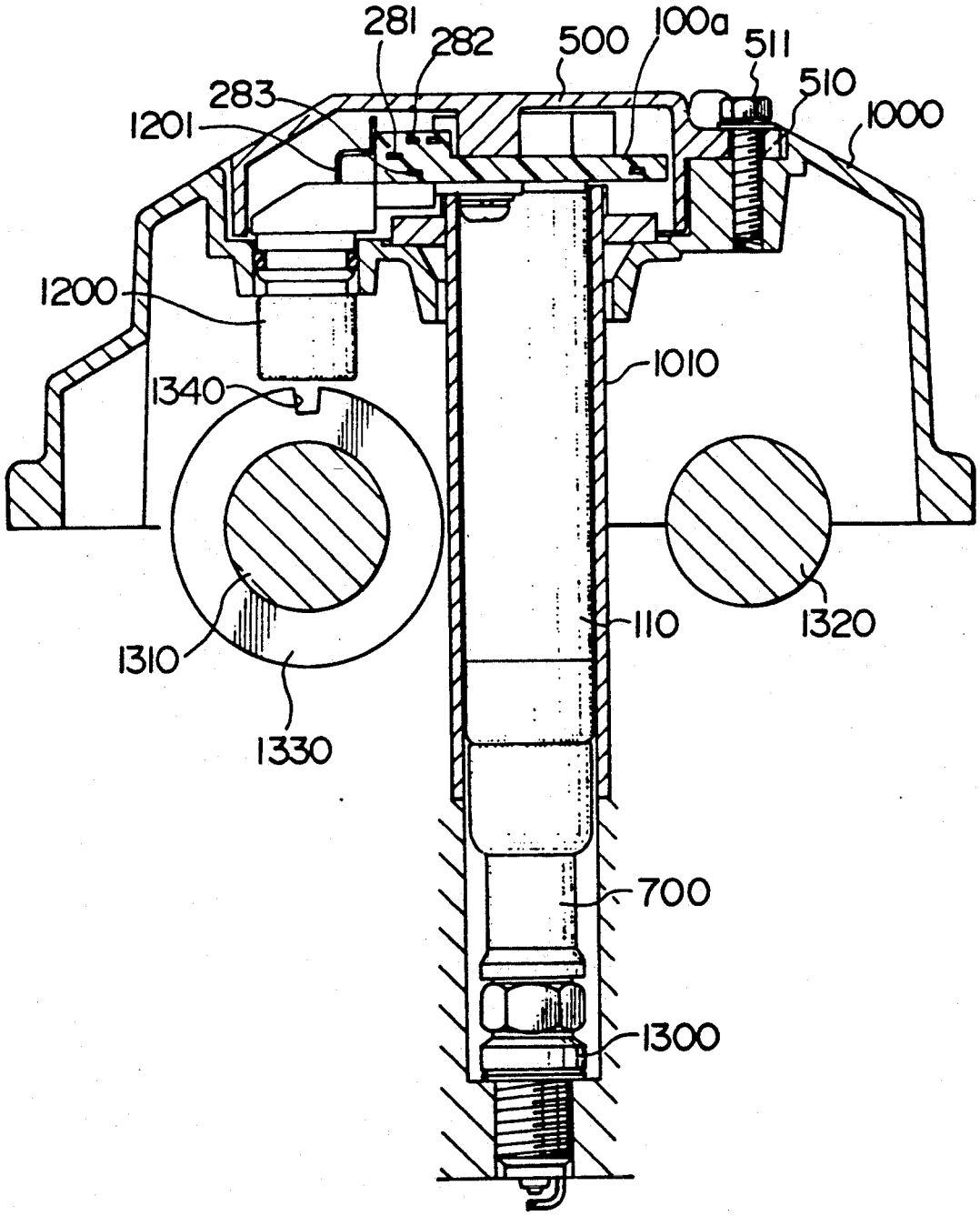
FIG. 8 is a vertical cross-sectional view of the fourth embodiment.

In a fourth embodiment of the invention shown in FIGS. 7 and 8, there is provided one sensor 1200 for sensing the operating condition of the engine. The sensor 1200 is fixed, together with igniters 900, to a coil case base portion 100*a*.

The sensor 1200 extends through an engine head cover 1000, and its distal end is opposed to a signal rotor 1330 in a closely spaced relation to the outer periphery of the signal rotor 1330. The signal rotor 1330 is made of a magnetic material, and is mounted on one (here, 1310) of the cam shafts 1310 and 1320. A notch 1340 is formed in an outer periphery of the signal rotor 1330. The sensor 1200 detects a change of the magnetic field due to the notch 1340 so as to sense the rotation frequency of the cam shaft (that is, the engine speed).

A terminal 1201 of the sensor 1200 is connected by welding or the like to one terminal of a connecting line extending upwardly from the coil case base portion 100*a*. The sensor 1200 is electrically connected to its mating portions via this connecting line and connector 150. Reference numeral 1300 denotes a spark plug.

In this embodiment, a plurality of lines 281, 282 and 283 are embedded in the coil case base portion 100*a* in a three-layer manner. Thus, a relatively small mounting region of the base portion 100*a* is effectively utilized.

Figure 9:
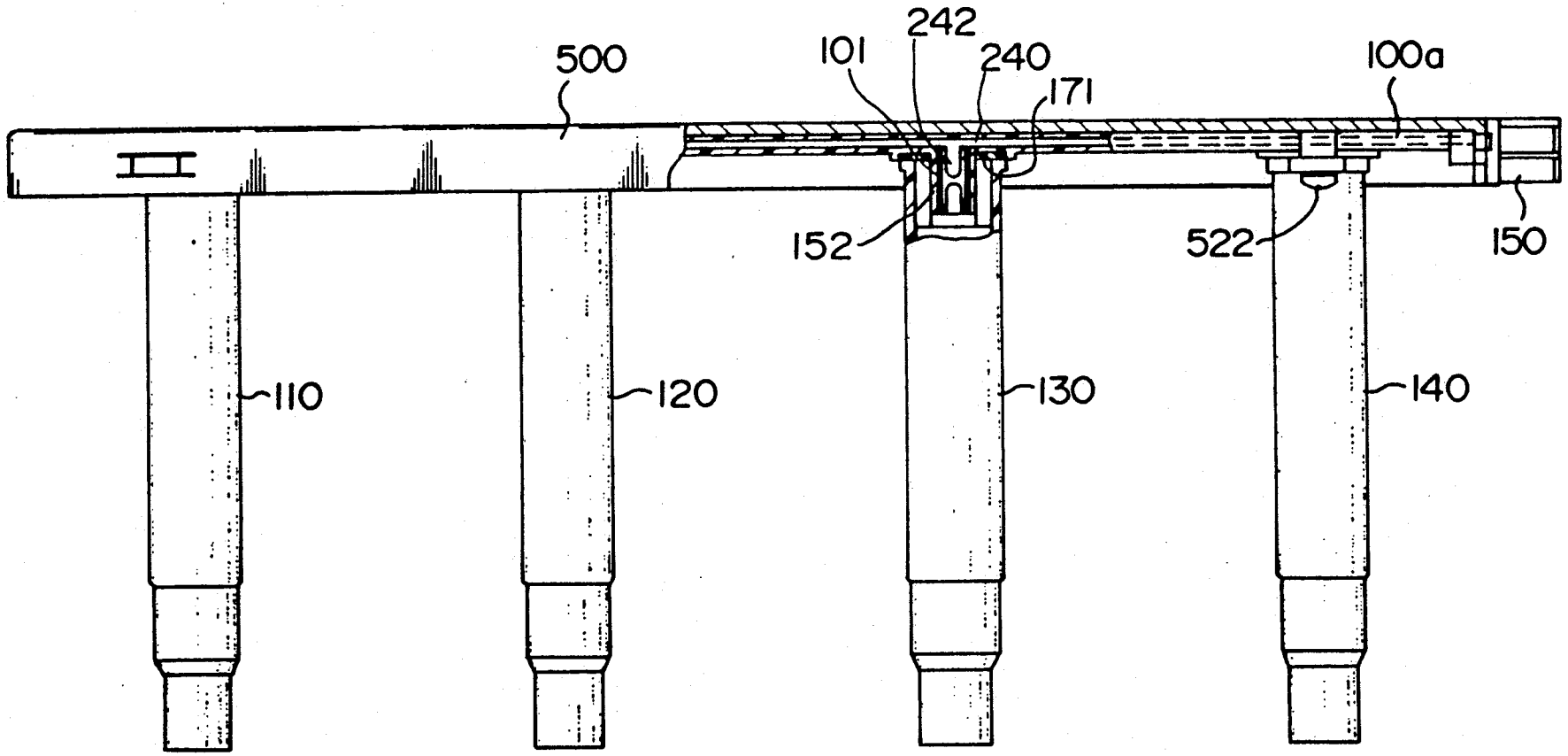
FIG. 9 is a partly cross-sectional front view of a fifth embodiment of an apparatus of the present invention.
Figure 10:
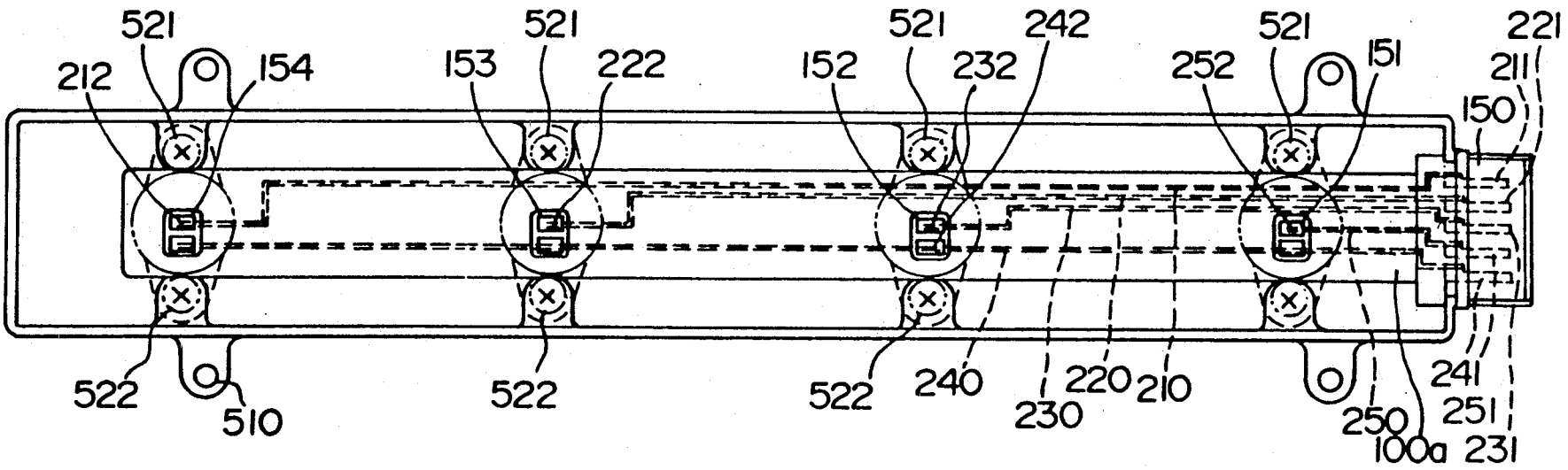
FIG. 10 is a bottom view of the fifth embodiment with coil towers omitted.

In a fifth embodiment of the invention shown in FIGS. 9 and 10, coil towers 110 to 140 are separate from a distributor plate base portion 100*a*, and are fixedly secured by bolts 521 and 522 to a metal bracket 500 serving as a decorative plate.

The distributor plate base portion 100*a* has an integral connector 150 for external connection, and integral coil-connecting connector portions 151 to 154 which extend vertically so as to correspond respectively to spark coils. Lines 210 to 250 for distributing electrical signals of an ignition timing control circuit and etc., to the spark coils are embedded in the distributor plate base portion 100*a*.

One ends 212 to 252 of the lines 210 to 250 are projected into the coil-connecting connector portions 151 to 154, respectively, whereas the other ends 211 to 251 of the lines 210 to 250 are projected into the external connection connector 150. The distributor plate base portion 100*a* is held between the heads of the coil towers 110 to 140 and the bracket 500.

The lines 210 to 250 extend parallel to one another in the direction of the width of the base portion 100*a*, and are disposed in parallel planes spaced in the direction of the thickness of the base portion 100*a*. With this arrangement, the distributor plate base portion 100*a* integrally incorporating these lines therein can be of a small size, and the increase of its widthwise dimension can be restrained.

A terminal 101 is inserted in each of the coil-connecting connector portions 151 to 154, and electrically connects each of the terminals 211 to 251, of the lines 210 to 250 to the corresponding spark coil.

An elastic rubber gasket 171 is sandwiched between the upper surface of each of the coil towers 110 to 140 and the lower surface of the distributor plate base portion 100*a* to waterproof the connecting portion between the spark coil and the distributor plate.

If the gasket 171 is so dimensioned as to be elastically deformed when fixing the spark coil to the bracket 500, the distributor plate base portion 100*a* can be urged against the bracket 500 by the gaskets 171.

Therefore, by fixing the spark coils, not only waterproof protection of the connecting portions, but also the fixing of the distributor plate can be achieved. This makes the attaching operation simpler, and also contributes to the reduction of the number of the fixing screws or other attachment means.

What is claimed is:

1. An apparatus for supplying a high voltage to each spark plug associated with a cylinder of a multi-cylinder internal combustion engine, said apparatus comprising:

a distributor plate made of an electrically insulative material having a base portion and a connector; said distributor plate, base portion, and connector being of unitary construction; said connector being adapted for connection to a voltage source;

coil towers associated with each spark plug projecting from said base portion;

at least one spark coil winding mounted within each coil tower for being electrically connected to an associated spark plug;

a plurality of connecting lines having first and second ends and a substantial portion of each connecting line being embedded in said base portion, said first ends being electrically connected to an associated spark coil winding, said second ends projecting into said connector;

an electrically insulative resin portion provided in each of said coil towers for fixedly retaining an associated spark coil winding in a coil tower;

a metal bracket for fixing said distributor plate and said coil towers to a cylinder head of said multi-cylinder internal combustion engine; and an igniter for intermitting electrical current flowing through said spark coil winding fixedly mounted on said base portion, said igniter being electrically connected to embedded portions of said connecting lines between said first and second ends.

2. An apparatus for supplying a high voltage to each spark plug associated with a cylinder of a multi-cylinder internal combustion engine, said apparatus comprising:

a distributor plate made of an electrically insulative material having a base portion and a connector; said distributor plate, base portion, and connector being of unitary construction; said connector being adapted for connection to a voltage source;

coil towers associated with each spark plug projecting from said base portion;

at least one spark coil winding mounted within each coil tower for being electrically connected to an associated spark plug;

a plurality of connecting lines having first and second ends and a substantial portion of each connecting line being embedded in said base portion, said first ends being electrically connected to an associated spark coil winding, said second ends projecting into said connector; and a sensor for sensing an operating condition of said internal combustion engine mounted on said base portion.

3. Apparatus according to claim 2, wherein said internal combustion engine includes a plurality of cam shafts provided at said cylinder head, and said sensor is in the form of a rotary sensor disposed in opposed relation to a cam shaft.

4. An apparatus for supplying a high voltage to each spark plug associated with a cylinder of a multi-cylinder internal combustion engine, said apparatus comprising:

a distributor plate made of an electrically insulative material having a base portion and a connector; said distributor plate, base portion, and connector being of unitary construction; said connector being adapted for connection to a voltage source;

coil towers associated with each spark plug projecting from said base portion;

at least one spark coil winding mounted within each coil tower for being electrically connected to an associated spark plug;

a plurality of connecting lines having first and second ends and a substantial portion of each connecting line being embedded in said base portion, said first ends being electrically connected to an associated spark coil winding, said second ends projecting into said connector;

an electrically insulative resin portion provided in each of said coil towers for fixedly retaining an associated spark coil winding in a coil tower; and a metal bracket for fixing said distributor plate and said coil towers to a cylinder head of said multi-cylinder internal combustion engine;

wherein said distributor plate is separate from said coil towers, said distributor plate and said coil towers being fixed to said metal bracket through a fixing member.

5. Apparatus according to claim 4, wherein said distributor plate is held between said metal bracket and said coil towers, each of said coil towers being fixed to said metal bracket by said fixing member.

6. Apparatus according to claim 5, further comprising an elastic member interposed between said distributor plate and each of said coil towers.

7. An apparatus for supplying a high voltage to each spark plug associated with a cylinder of a multi-cylinder internal combustion engine, said apparatus comprising:

a distributor plate made of an electrically insulative material having a base portion and a connector; said distributor plate, base portion, and connector being of unitary construction; said connector being adapted for connection to a voltage source;

coil towers associated with each spark plug projecting from said base portion;

at least one spark coil winding mounted within each coil tower for being electrically connected to an associated spark plug;

a plurality of connecting lines having first and second ends and a substantial portion of each connecting line being embedded in said base portion, said first ends being electrically connected to an associated spark coil winding, said second ends projecting into said connector;

an electrically insulative resin portion provided in each of said coil towers for fixedly retaining an associated spark coil winding in a coil tower; and a metal bracket for fixing said distributor plate and said coil towers to a cylinder head of said multi-cylinder internal combustion engine;

an igniter for interrupting primary electric current flowing through said spark coil windings fixedly mounted on said base portion, said igniter including a radiator plate having a flange, said flange and said base portion being fixedly fastened to said metal bracket.

8. Apparatus according to claim 7, wherein said metal bracket has integral projections for detaching said apparatus from said engine.

9. Apparatus according to claim 8, wherein said projections are radiating fins.

10. Apparatus according to claim 7, further comprising a heat transfer material is filled in a space between said radiator plate and said bracket.

11. Apparatus according to claim 10, wherein said metal bracket has integral projections for detaching said apparatus from said engine.

12. Apparatus according to claim 11, wherein said projections are radiating fins.

13. An apparatus for supplying a high voltage to each spark plug associated with a cylinder of a multi-cylinder internal combustion engine, said apparatus comprising:

a distributor plate made of an electrically insulative material having a base portion and a connector; said distributor plate, base portion, and connector being of unitary construction; said connector being adapted for connection to a voltage source;

coil towers associated with each spark plug projecting from said base portion;

at least one spark coil winding mounted within each coil tower for being electrically connected to an associated spark plug; and a plurality of connecting lines having first and second ends and a substantial portion of each connecting line being embedded in said base portion, said first ends being electrically connected to an associated spark coil winding and projecting up from said base portion adjacent to said associated spark coil winding, said second ends projecting into said connector.

14. An apparatus according to claim 13, wherein said distributor plate and said coil towers are integrally formed of an electrically insulative material.

15. Apparatus according to claim 13, wherein said connecting lines extend in planes disposed in said base portion and spaced from each other.

16. An apparatus according to claim 13, further comprising:

an electrically insulative resin portion provided in each of said coil towers for fixedly retaining an associated spark coil winding in a coil tower; and a metal bracket for fixing said distributor plate and said coil towers to a cylinder head of said multi-cylinder internal combustion engine.

17. An apparatus according to claim 13, wherein said connecting lines are made of a metallic plate.

18. An apparatus according to claim 13, further comprising:

an igniter for intermitting electrical current flowing through said spark coil winding fixedly mounted on said base portion, said igniter being electrically connected to embedded portions of said connecting lines between said first and second ends.

* * * * *